US006605259B1

(12) United States Patent
Henry

(10) Patent No.: US 6,605,259 B1
(45) **Date of Patent: *Aug. 12, 2003**

(54) MANIFOLD CONVERTER

(75) Inventor: Matthew Meredith Henry, Lake Orion, MI (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 68 days.

(21) Appl. No.: 08/697,478

(22) Filed: Aug. 26, 1996

Related U.S. Application Data

(63) Continuation of application No. 08/515,724, filed on Aug. 16, 1995, now abandoned.

(51) Int. Cl.[7] ..... B01D 53/94; F01N 3/28; F01N 7/14

(52) U.S. Cl. ..... 422/179; 422/177; 422/180

(58) Field of Search ..... 422/171, 177, 422/179, 180, 211, 221, 222; 60/299, 302; 181/240

(56) References Cited

U.S. PATENT DOCUMENTS

| | | | | | |
|---|---|---|---|---|---|
| 3,892,537 | A | * | 7/1975 | Gulati | 422/179 |
| 3,990,859 | A | * | 11/1976 | Waite | 422/179 |
| 4,261,170 | A | | 4/1981 | Suzuki | 60/303 |
| 4,279,864 | A | * | 7/1981 | Nara et al. | 422/179 |
| 4,328,187 | A | * | 5/1982 | Musall et al. | 422/179 |
| 4,335,078 | A | * | 6/1982 | Ushijima et al. | 422/179 |
| 4,448,754 | A | * | 5/1984 | Isogai et al. | 422/180 |
| 5,220,789 | A | * | 6/1993 | Riley et al. | 422/180 |
| 5,250,269 | A | * | 10/1993 | Langer | 422/179 |

FOREIGN PATENT DOCUMENTS

| | | |
|---|---|---|
| DE | U-9210836 | 10/1992 |
| EP | A-117602 | 9/1984 |
| EP | A-256416 | 2/1988 |
| FR | A-2422028 | 11/1979 |

OTHER PUBLICATIONS

Patent Abstracts of Japan vol. 7, No. 68 (M–201), Mar. 19, 1983 & JP–A–57 210117 (Toyota Jidosha), Dec. 23, 1982.

Patent Abstracts of Japan vol. 7, No. 126 (M–219), May 31, 1983 & JP–A–58 044211 (Yamaha Hatsudoki) Mar. 15, 1983.

European Search Report corres to EP 96 20 1897 dated Nov. 27, 1996 & Annex.

* cited by examiner

*Primary Examiner*—Hien Tran
(74) *Attorney, Agent, or Firm*—Vincent A. Cichosz

(57) ABSTRACT

The present invention includes a manifold catalytic converter. The catalytic converter is positioned immediately adjacent the manifold. The manifold and the converter end cone are cast from a single integral piece. The manifold/converter end cone casting includes an end cone portion having an end cone wall having a shoulder formed therein for engaging the front face of a catalytic converter substrate. A lip or ledge extends from the shoulder and surrounds and engages the outer surface of the ceramic substrate immediately adjacent the front face of the substrate. A metal shell is connected to the end cone and is spaced apart from the ceramic substrate. A support material is provided between the ceramic substrate and the metal shell. A second end cone is connected to the shell.

10 Claims, 1 Drawing Sheet

MANIFOLD CONVERTER

This is a continuation of application Ser. No. 08/515,724 filed on Aug. 16, 1995, now abandoned.

FIELD OF THE INVENTION

This invention relates to catalytic converters for a combustion engine, and more particularly, to a catalytic converter having a portion thereof integrated into the exhaust manifold.

BACKGROUND OF THE INVENTION

Common exhaust systems for a combustion engine include a manifold connected to the combustion engine atone end and bolted to an exhaust pipe at the other end. The exhaust pipe extends a distance from the manifold and has a catalytic converter system bolted thereto. These catalytic converter systems include a ceramic substrate having a catalyst coated thereon and a metal housing surrounding the substrate. A support mat is placed between the ceramic substrate and the metal housing. Although the ceramic substrate expands and contracts relatively little during operation of the combustion engine, the metal housing expands and contracts greatly. The mat support expands and contracts with heat to keep the ceramic substrate held firmly in the converter housing.

As the catalytic converter is moved closer to the engine, the difference in thermal expansion between the housing and the ceramic substrate becomes exacerbated. Further, as the converter system is moved closer to the combustion engine, the converter system sees violent pressure pulsations. These violent pressure pulsations tend to erode and damage the mat support. This may result in damage to the ceramic substrate since the mat would no longer be able to keep the substrate in place or may cause it to become dislodged. Once dislodged, the substrate will be broken up into pieces due to vibrations and blown downstream.

The present invention provides advantages over the prior art.

SUMMARY OF THE INVENTION

The present invention includes a manifold catalytic converter. The catalytic converter is positioned immediately adjacent the manifold. The manifold and the converter end cone are cast from a single integral piece and are not bolted together. The manifold/converter end cone casting includes an end cone wall having a shoulder formed therein for engaging the front face of a catalytic converter substrate. A lip or ledge extends from the shoulder and surrounds the outer surface of the ceramic substrate immediately adjacent the front face of the substrate. This lip or ledge provides a pressure pulsation barrier so the mat will not erode. A housing for the ceramic substrate is provided and is spaced apart from the ceramic substrate. A resilient support material is provided between the ceramic substrate and the housing. A second end cone is connected to the housing.

These and other objects, features and advantages will be apparent from the following brief description of the drawings, detailed description and appended drawings and claims.

DETAILED DESCRIPTION

Figure 1:
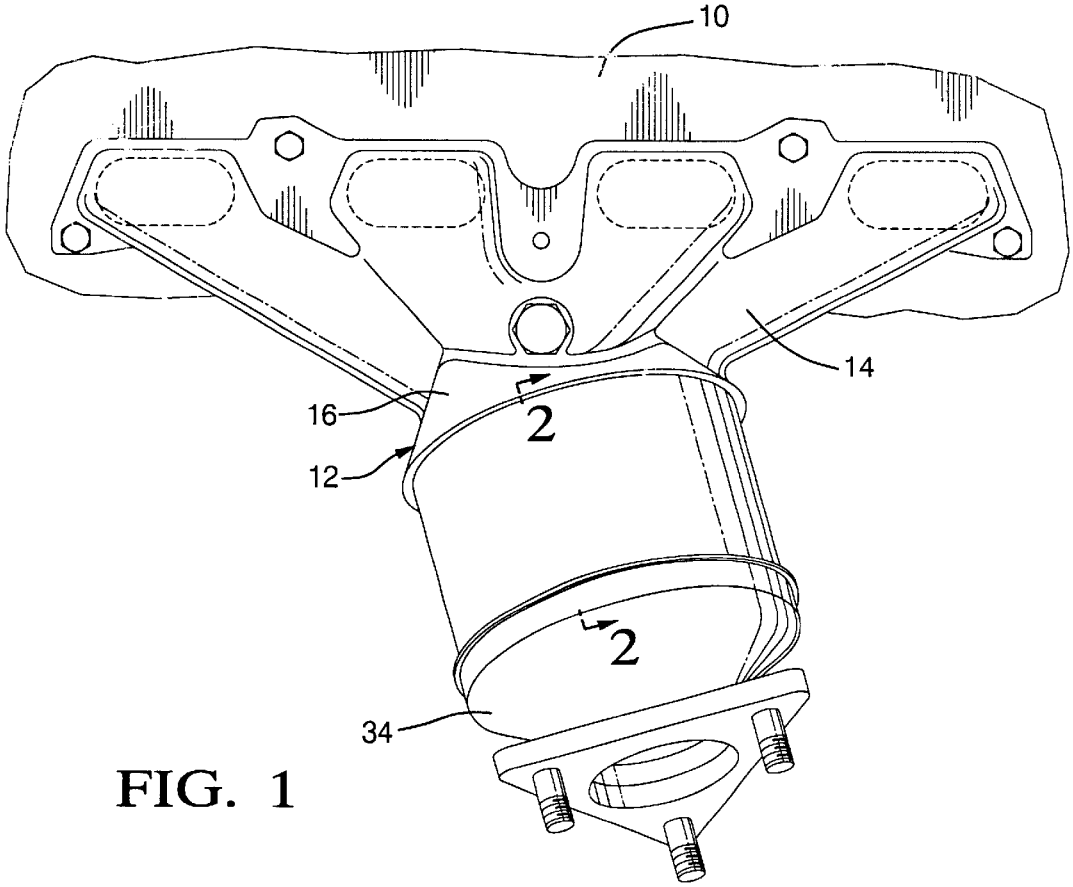
FIG. 1 is a schematic illustration of a combustion engine including a manifold converter according to the present invention.
Figure 2:
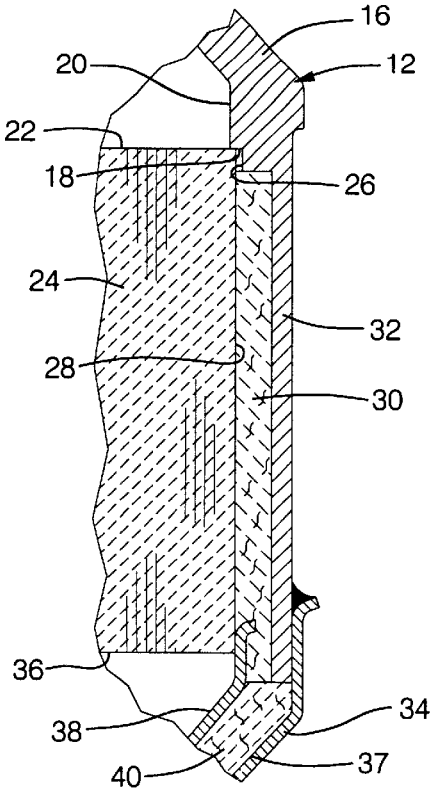
FIG. 2 is a partial sectional view taken along line 2—2 of a manifold catalytic converter according to the present invention.

FIG. 1 is a schematic illustration of a combustion engine 10 and exhaust system used in an automobile or truck. The combustion engine 10 has a manifold catalytic converter 12 according to the present invention attached thereto. The manifold catalytic converter as shown in FIG. 2 is a single piece integral casting including a manifold 14 and catalytic converter end cone 16. The end cone portion 16 of the manifold catalytic converter includes a shoulder 18, preferably extending out at a right angle to a portion of the end cone wall 20 (FIG. 2). The shoulder is formed to engage the front face 22 of a catalytic converter substrate 24 which has a catalyst coated thereon. A lip 26 extends from the shoulder, preferably at a right angle. The lip 26 surrounds a portion of the outer surface 28 of the ceramic substrate at a location immediately adjacent the front face 22 of the ceramic substrate. A substrate housing 32 extends from the end cone and is spaced a distance from the ceramic substrate. The substrate housing 32 may also be a part of the single piece integral casting or it may be a separate metal shell which is attached to the end cone 16. A resilient support mat 30 is provided between the ceramic substrate 24 and the substrate housing 32 to compensate for thermal expansion and contraction of the housing. A suitable support mat is available from 3M company under the trade name Intumescent Mat Support. A second end cone 34 is attached to the housing 32 at a location near the rear face 36 of the ceramic substrate. The second end cone may have two spaced apart walls 37, 38 and a second mat insulation 40 carried therebetween.

The manifold catalytic converter 12 of the present invention places the catalytic converter substrate and catalyst immediately adjacent the manifold 14 and engine 10. The temperatures of the exhaust gas at this location are relatively high as compared to traditional exhaust system arrangements wherein the converter is spaced a substantial distance downstream from the engine and manifold. This provides for rapid lightoff of the catalyst. The shoulder 18 and lip 26 of the single cast end cone portion prevents high pressure and high variation exhaust flows from impinging on the support mat 30 and thus eliminates any possibility that the mat will be eroded or deteriorated. The manifold catalytic converter of the present invention eliminates a variety of bolts and flanges, and allows for a smaller packaging envelope which reduces the overall distance of the exhaust system which is particularly advantageous for smaller vehicles. As used herein, the term single piece integral casting means a component that is cast as one single piece and does not include two or more parts bolted or welded together.

What is claimed is:

1. A manifold catalytic converter comprising:

a ceramic substrate having a catalytic coating thereon; said ceramic substrate having a front face, rear face and an outer surface connecting said faces;

a single piece integral casting comprising a manifold, first converter end, shoulder, lip, and shell; said first converter end immediately adjacent said manifold, said first converter end being defined in part by a wall that expands from a first end connected to the manifold toward a second end, said wall having an inside surface in fluid communication with said manifold and said ceramic substrate;

said shoulder being formed at the second end, said shoulder being constructed and arranged to engage the front face of the ceramic substrate;

said lip extending from the shoulder and surrounding a portion of the outer surface of the ceramic substrate immediately adjacent both the front face and the portion of the outer surface of the ceramic substrate;

said shell extending from the lip to house said substrate, said shell being spaced a distance from the outer surface of the ceramic substrate;

a resilient mat positioned between the shell and the ceramic substrate; and wherein the shoulder and lip are positioned to prevent high pressure and high vibration exhaust flows from impinging on the resilient mat and prevent the mat from eroding; and a second converter end secured to the shell.

2. A manifold catalytic converter as set forth in claim 1 wherein said second converter end comprises a pair of spaced apart walls for receiving a portion of said shell therebetween.

3. A manifold catalytic converter comprising:

a ceramic substrate having a catalytic coating thereon; said ceramic substrate having a front face, rear face and an outer surface connecting said faces;

a single piece integral casting comprising a manifold, first converter end, shoulder, lip and shell; said first converter end being immediately adjacent said manifold, said first converter end being defined in part by a wall that expands from a first end connected to the manifold toward a second end, said wall having an inside surface in fluid communication with said manifold and said ceramic substrate;

said shoulder being formed at the second end, said shoulder being constructed and arranged to engage the front face of the ceramic substrate;

said lip extending from the shoulder and surrounding a portion of the outer surface of the ceramic substrate immediately adjacent both the front face and the portion of the outer surface of the ceramic substrate;

said shell extending from the lip to house said substrate, said shell being spaced a distance from the outer surface of the ceramic substrate; and a resilient mat positioned between the shell and the ceramic substrate.

4. A manifold catalytic converter as set forth in claim 3 further comprising a second converter end comprises a pair of spaced apart walls for receiving a portion of said shell therebetween.

5. A manifold catalytic converter as set forth in claim 3 wherein the said first end of the wall is narrower than said second end.

6. A manifold catalytic converter comprising:

a ceramic substrate having a catalytic coating thereon; said ceramic substrate having a front face, rear face and an outer surface connecting said faces;

a single piece integral casting comprising a manifold, first converter end, shoulder and lip; said first converter end immediately adjacent said manifold, said first converter end being defined in part by a wall that expands from a first end connected to the manifold toward a second end, said wall having an inside surface in fluid communication with said manifold and the ceramic substrate;

said shoulder being formed at the second end, said shoulder being constructed and arranged to engage the front face of the ceramic substrate; and said lip extending from the shoulder and surrounding a portion of the outer surface of the ceramic substrate immediately adjacent both the front face and the portion of the outer surface of the ceramic substrate.

7. A manifold catalytic converter comprising:

a ceramic substrate having a catalytic coating thereon; said ceramic substrate having a front face, rear face and an outer surface connecting said faces;

a single piece integral casting comprising a manifold, first converter connecting section, shoulder, lip, and shell; said first converter connecting section immediately adjacent said manifold, said first converter connecting section being defined in part by a wall that expands from a first end connected to the manifold toward a second end, said wall having an inside surface in fluid communication with said manifold and said ceramic substrate;

said shoulder being formed on the inside surface of the wall, said shoulder being constructed and arranged to engage the front face of the ceramic substrate;

said lip extending from the shoulder and surrounding a portion of the outer surface of the ceramic substrate immediately adjacent both the front face and the portion of the outer surface of the ceramic substrate;

said shell extending from the lip to house said substrate, said shell being spaced a distance from the outer surface of the ceramic substrate;

a resilient mat positioned between the shell and the ceramic substrate; and wherein the shoulder and lip are positioned to prevent high pressure and high vibration exhaust flows from impinging on the resilient mat and prevent the mat from eroding; and a second connecting section secured to the shell.

8. A manifold catalytic converter as set forth in claim 7 wherein said second connecting section comprises a pair of spaced apart walls for receiving a portion of said shell therebetween.

9. A manifold catalytic converter comprising:

a ceramic substrate having a catalytic coating thereon; said ceramic substrate having a front face, rear face and an outer surface connecting said faces;

a single piece integral casting comprising a manifold, first converter end, shoulder, lip, and shell; said first converter end immediately adjacent said manifold, said first converter end being defined in part by a wall that expands from a first end connected to the manifold toward a second end, said wall having an inside surface in fluid communication with said manifold and said ceramic substrate;

said shoulder being formed inside the wall, said shoulder being constructed and arranged to engage the front face of the ceramic substrate;

said lip extending from the shoulder and surrounding a portion of the outer surface of the ceramic substrate immediately adjacent both the front face and the portion of the outer surface of the ceramic substrate;

said shell extending from the lip to house said substrate, said shell being spaced a distance from the outer surface of the ceramic substrate;

a resilient mat positioned between the shell and the ceramic substrate; and wherein the shoulder and lip are positioned to prevent high pressure and high vibration exhaust flows from impinging on the resilient mat and prevent the mat from eroding; and a second converter end secured to the shell.

10. A manifold catalytic converter as set forth in claim 9 wherein said second converter end comprises a pair of spaced apart walls for receiving a portion of said shell therebetween.

* * * * *